United States Patent [19]

Wilsey

[11] Patent Number: 5,036,550

[45] Date of Patent: Aug. 6, 1991

[54] SPORTS TIE

[76] Inventor: Steven M. Wilsey, 927 Anchorage Ct., Oshkosh, Wis. 54901

[21] Appl. No.: 539,443

[22] Filed: Jun. 18, 1990

[51] Int. Cl.[5] ..... A41D 25/00

[52] U.S. Cl. ..... 2/144; 2/145

[58] Field of Search ..... 2/144, 145, 146

[56] References Cited

U.S. PATENT DOCUMENTS 4,627,113 12/1986 Lord ..... 2/144

*Primary Examiner*—Werner H. Schroeder
*Assistant Examiner*—Gloria Hale
*Attorney, Agent, or Firm*—Donald Cayen

[57] ABSTRACT

A sports tie is comprised of a plurality of rigid segments flexibly joined together in the form of a necktie. The exposed surfaces of the segments are finished to simulate a basketball court. The logo or other insignia of a sports team is bonded to the exposed surfaces of the segments. A band or clip attached to an end segment allows a person to wear the sports tie around his neck. In a modified embodiment, the segments have the outline of a baseball bat. In a further embodiment, the segments are covered with artificial football field material. In another embodiment, the segments are made of clear plastic to simulate a hockey rink. Disks decorated to represent various sports balls or pucks can be bonded to a segment.

16 Claims, 2 Drawing Sheets

SPORTS TIE

BACKGROUND OF THE INVENTION

1. Field of the Invention

This invention pertains to wearing apparel, and more particularly to neckties.

2. Description of the Prior Art

Numerous types of neckwear have been developed over the years. Various kinds of bow ties and long ties are commonly worn by both men and women.

It is known to imprint ties with insignias or symbols that advertise or promote different organizations and occupations. For example, ties bearing fraternity symbols and company trademarks are readily available.

Many sports fans identify themselves closely with their favorite teams. The fans frequently wear shirts and hats to games and elsewhere to show loyalty and enthusiasm for their teams. Such team-related clothing occasionally includes neckties imprinted with the team logo or insignia.

Regardless of their decorative features, neckties are invariably made from a flexible material. The material may be a woven textile, or it may be a woven or non-woven synthetic textile-like material. Such flexible materials are limited in their ability to accurately represent certain features and characteristics of the various sports. For example, flexible ties are unable to duplicate the types of surfaces on which basketball and hockey games are played.

SUMMARY OF THE INVENTION

In accordance with the present invention, a sports tie is provided that realistically displays background information regarding a selected sport and team. This is accomplished by making the tie from multiple segments of a thin rigid material that accurately represent the surface on which the selected sport is played.

The segments are arranged in the form of an elongated rectangle having the general size and shape of a conventional long necktie. The segment material is preferably oak or maple approximately 0.13 inches thick. The exposed surfaces of the segments are finished to simulate the floor of a basketball court. In an alternate embodiment, the segments are made from pieces of clear plastic so as to simulate the ice of a hockey rink. The segments' exposed surfaces can be partially covered with a decorative logo or insignia representing the wearer's favorite team. In another variation, the segments are covered with artificial turf representative of a football field, and the turf is printed with the team logo. The segments are joined to each other by strips of flexible tape so as to create transverse hinges between adjacent segments.

Further in accordance with the present invention, the sports tie comprises a rigid element that simulates a piece of sports equipment, as, for example, a basketball. The simulated basketball may be removably applied to the segment located at the neck end of the tie so as to replace the outline of the usual knot. If desired, the rigid element may constitute only a portion of the simulated basketball or other piece of equipment.

The sports tie is may be worn by means of an elastic strap. One end of the strap may be permanently attached to the segment at the neck end, and the other strap end is removably attached to the opposite side of the neck end segment. Alternately, two short straps may be used, with one end of each strap attached to the neck end segment and the second ends of the straps removably attachable to each other. If desired, a conventional clip or hook can be incorporated into the segment at the neck end for hooking onto a shirt. The clip or hook may be a known two position snap type.

In use, the sports tie presents an attractive and realistic identification of the particular sports team and playing background. The rigid and finished tie segments faithfully represent such playing surfaces as a hardwood court, ice rink, or football field without impairing wearability or interfering with the wearer's movements.

Other advantages, benefits, and features of the invention will become apparent to those skilled in the art upon reading the detailed description of the invention.

DETAILED DESCRIPTION OF THE INVENTION

Although the disclosure hereof is detailed and exact to enable those skilled in the art to practice the invention, the physical embodiments herein disclosed merely exemplify the invention, which may be embodied in other specific structure. The scope of the invention is defined in the claims appended hereto.

Figure 1:
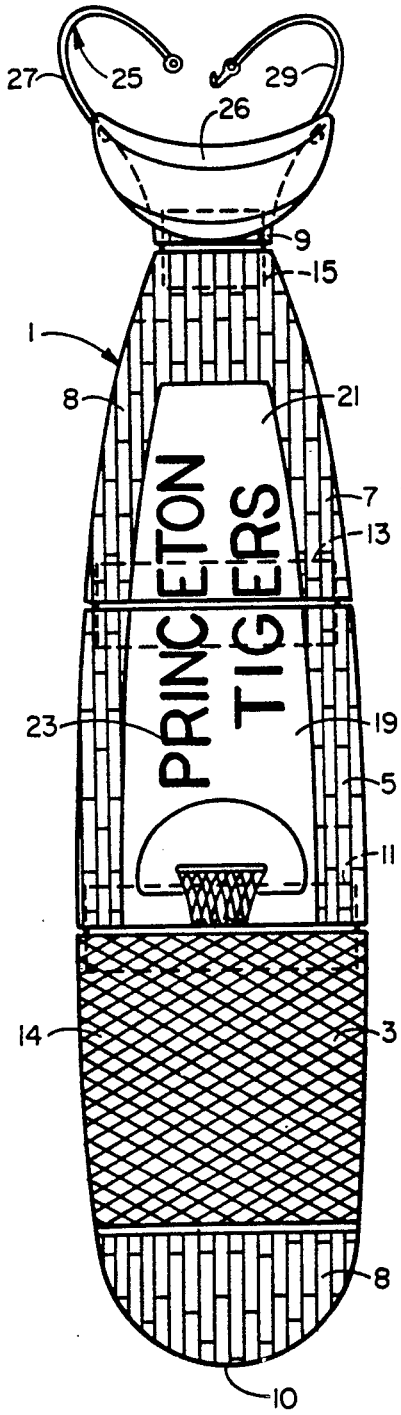
FIG. 1 is a front view of a sports tie according to the present invention.
Figure 2:
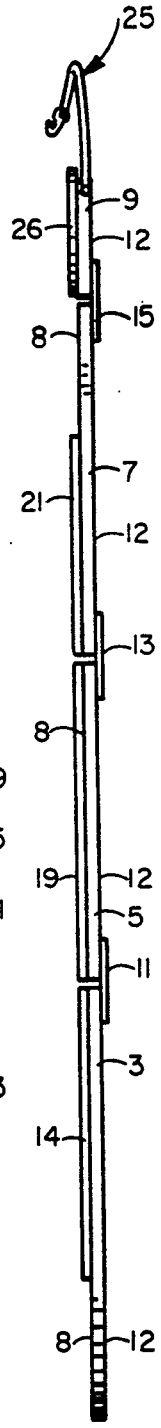
FIG. 2 is a side view of FIG. 1.

Referring to FIGS. 1 and 2, a sports tie 1 is illustrated that includes the present invention. The sports tie is particularly useful for displaying insignias and other decorations pertaining to sports teams, but it will be understood that the invention is not limited to athletic related applications.

The sports tie 1 is comprised of a plurality of relatively rigid segments that are hinged together. In the particular construction illustrated, the sports tie contains four segments 3, 5, 7, and 9. The outlines of the individual segments are such that when the segments are placed in end-to-end relation they form the general outline of a conventional long necktie. Preferably, the segments 3, 5, 7, and 9 are made of hardwood attractively finished on their respective exposed surfaces 8 to mimic the floor of a basketball court. Most of the exposed surface 8 of the segment 3 is covered or painted in area 14 with a solid color, and the lower or free end 10 of the segment 3 is formed as a semi-circle. The segment 3 thus represents the lane or free throw area of a basketball court.

To retain the segments 3, 5, 7, and 9 together, their respective adjacent ends are joined with strips of flexible tape. Thus, segments 3 and 5 are flexibly joined with strip 11 of flexible tape, segments 5 and 7 are joined with tape strip 13, and segments 7 and 9 are joined with tape strip 15. The strips of tape 11, 13, and 15 are applied to the back sides 12 of the respective segments. The strips may be of any suitable tape, such as a single sided pressure sensitive tape having good fatigue properties. In that manner, the strips form hinges between the segments.

To the exposed surfaces 8 of the segments 5 and 7 are bonded respective decorative decals or stickers 19 and 21. When placed in end-to-end relation on the segments, the decals or stickers 19 and 21 cooperate to form a complete insignia or logo 23 that represents the wearer's favorite sports team. It is preferred that the decorative decals or stickers do not cover the entire area of the segments, but rather a margin of finished hardwood is left exposed around the periphery of the sports tie 1. If desired, only a single decal 19 or 21 may be bonded to the associated segment 5 or 7.

In the illustrated construction, the sports tie 1 includes a flexible band 25 for suspending the sports tie around the wearer's neck. The band 25 may be in two pieces 27 and 29, with the first ends of the pieces being fixed to the segment 9 and the second ends being removably attachable to each other. A single long piece having one end permanently attached to the segment 9 and the other end removably attachable thereto is also satisfactory. If desired, the band may be elastic. Alternately, a clip, not shown, may be integrated into the neck segment 9. The clip hooks onto the wearer's shirt in a manner identical to conventional ties. For ease in putting on and taking off the sports tie 1, the clip may have a two position snap action.

Further in accordance with the present invention, the sports tie 1 includes at least a portion of a disk 26 that is removably applied to the segment 9. The disk portion 26 is decorated to represent a basketball. A pressure sensitive tape may be used to releaseably apply the disk portion to the segment. It will be appreciated, of course, that a fully round disk may be employed. Further, the location of the hinge between the segments 7 and 9 can vary to suit the particular size and shape of the disk.

The hinges between the various segments 3, 5, 7, and 9 enable a person to wear the sports tie 1 with comfort. Further, the combination of the finished hardwood segments and the insignia or logo 23 created by the decals or stickers 19 and 21 render the sports tie 1 a very attractive means of identifying and publicizing a team.

Figure 3:
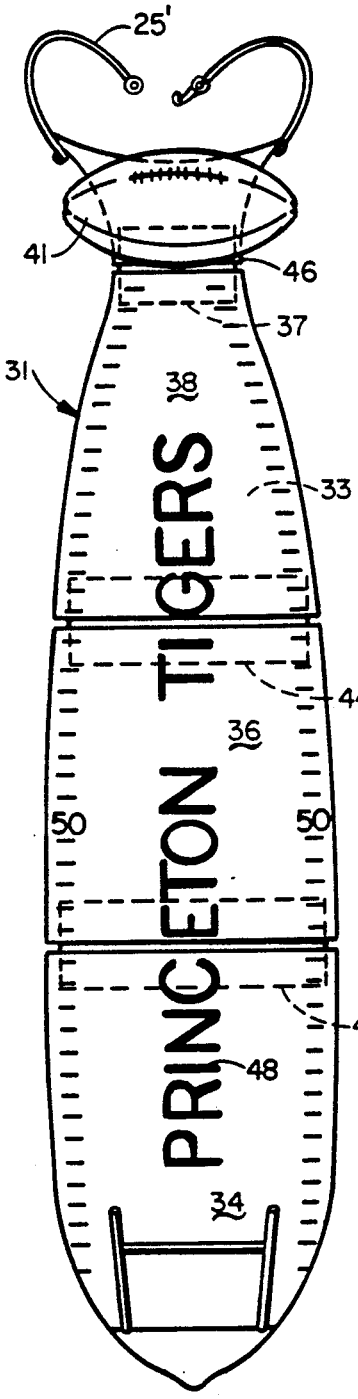
FIG. 3 is a front view of a modified embodiment of the invention.
Figure 4:
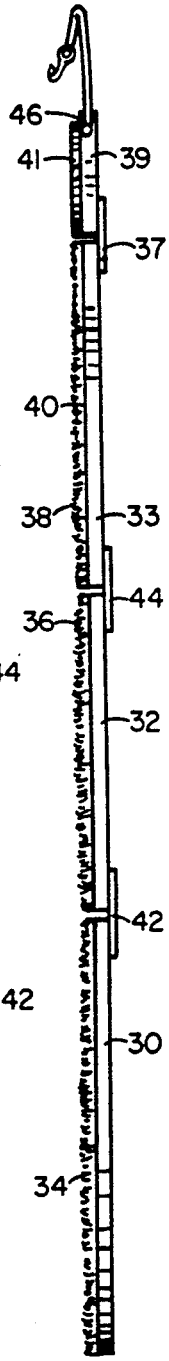
FIG. 4 is a side view of FIG. 3.

Now looking at FIGS. 3 and 4, a modified sports tie 31 is illustrated. The sports tie 31 is somewhat similar to the sports tie 1 described previously in connection with FIGS. 1 and 2. The sports tie 31 has segments 30, 32, 33, and 39 that may be substantially identical in size and shape to the respective segments 3, 5, 7, and 9. However, the segments 30, 32, 33, and 39 may be made of any generally rigid material; the material need not have a finished wood appearance on any surface. Rather, the front sides 40 of the segments 30, 32, and 33 are completely covered with respective pieces 34, 36, and 38 of ASTRO-TURF sports carpeting. It is preferred that the segment 39 not be covered with ASTRO-TURF sports carpeting. Segments 30 and 32 are joined by flexible tape strip 42. Tape strip 44 is used to flexibly join segments 32 and 33 to each other, and segment 33 is flexibly joined to segment 39 by tape strip 37.

The sports tie 31 is further comprised of a decorative piece 41 removably applied to the exposed surface 46 of the segment 39. The piece 41 is fabricated with a generally ovular outline and is decorated to represent a football. The outline of a full football is depicted, but the outline of only a partial football may be used, if desired. A pressure sensitive adhesive tape may be used to apply the football piece 41 to the segment 39. The exposed surfaces of the ASTRO-TURF pieces 34, 36, and 38 are printed or otherwise decorated with an insignia or logo 48 representative of the wearer's favorite football team. A band 25' or clip (not shown) is used to hold the sports tie 31 to the wearer's neck.

Figure 5:
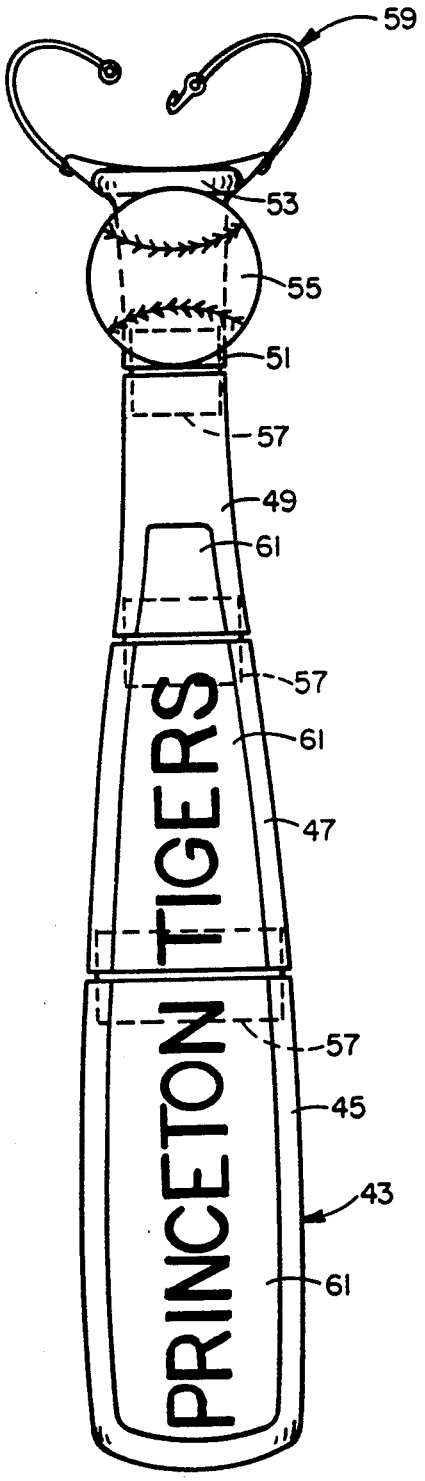
FIG. 5 is a front view of a further modified embodiment of the invention.

Turning to FIG. 5, a further modified sports tie 43 is depicted. The sports tie 43 has segments 45, 47, 49, and 51 that form the outline of a baseball bat. The neck segment 51 has the general shape of a bat handle 53. The sports tie 43 also may include a disk 55 removably applied, as by a pressure sensitive tape, to the neck segment 51. The disk 55 is decorated to represent a baseball. The remaining components of the sports tie 43, including the flexible tape strips 57, band 59, and decorative decals or stickers 61 are substantially similar to the corresponding components of the sports tie 1 described previously.

Figure 6:
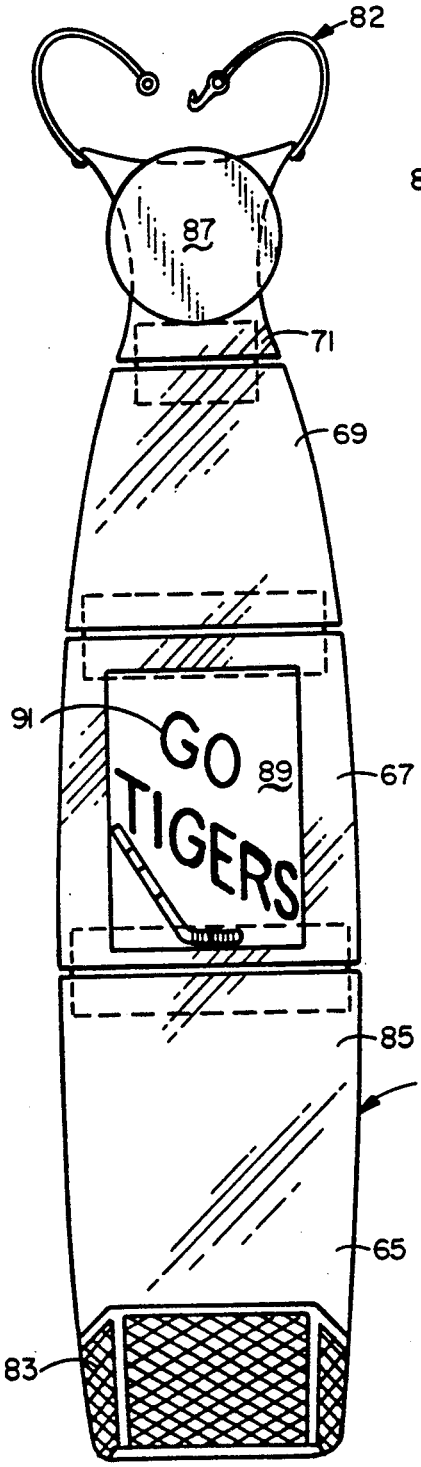
FIG. 6 is a front view of another embodiment of the invention.
Figure 7:
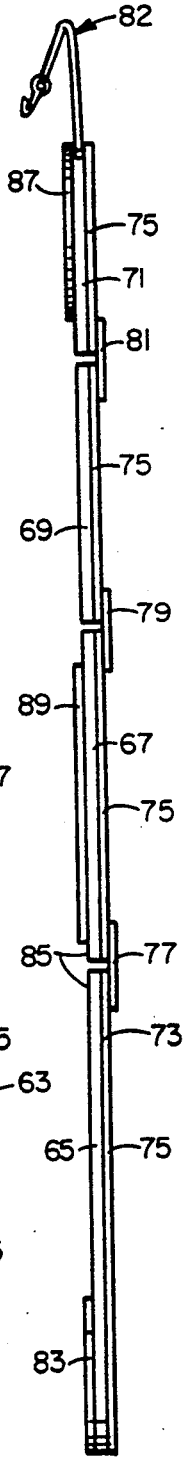
FIG. 7 is a side view of FIG. 6.

FIGS. 6 and 7 illustrate another embodiment of the present invention. The sports tie 63 of FIGS. 6 and 7 is intended to identify and support a hockey team. For that purpose, the segments 65, 67, 69, and 71 of the sports tie 63 are made of a clear plastic material. To the back sides 73 of the segments 65, 67, 69, and 71 are bonded respective colored sheets 75. The sheets 75 are preferably colored pale blue or gray so as to represent ice. The thickness of the clear plastic segments gives an illusion of depth and thickness to the simulated ice.

To join the segments 65, 67, 69, and 71 together into the sports tie 63, flexible tape strips are employed. Accordingly, tape strip 77 is bonded to the respective sheets 75 of the segments 65 and 67; tape strip 79 is bonded to the sheets 75 of the segments 67 and 69; and tape strip 81 is bonded to the sheets 75 of the segments 69 and 71. A band 82 or clip (not shown) is used to wear the sports tie 63 around a person's neck.

Additional indicia on the hockey sports tie 63 includes a decal or sticker 83 bonded to the exposed surface 85 of the free end of the segment 65. The decal or sticker 83 is designed to represent a hockey net. A disk 87 is removably applied to the neck segment 71. The disk 87 is preferably painted black so as to represent a hockey puck. A decal or sticker 89 bonded to the exposed surface 85 of one or more segments 65, 67, and 69 displays the particular insignia or logo 91 of the wearer's favorite hockey team.

The sports ties 1, 31, 43, and 63 enable a sports fan to promote his favorite team in a novel, attractive, and inexpensive manner. The flexible nature of the sports ties enables a person to realistically and comfortably combine the representations of a playing surface with the insignia or logo of his favorite team.

Thus, it is apparent that there has been provided, in accordance with the invention, a sports tie that fully satisfies the aims and advantages set forth above. While the invention has been described in conjunction with specific embodiments thereof, it is evident that many alternatives, modifications, and variations will be apparent to those skilled in the art in light of the foregoing description. For example, sports ties representing volleyball, soccer, bowling, and golf are readily made by appropriately decorating the hinged segments and the removable disks. Accordingly, it is intended to embrace all such alternatives, modifications, and variations as fall within the spirit and broad scope of the appended claims.

I claim:

1. A sports tie comprising:

a. a plurality of generally flat rigid segments having respective exposed surfaces and being arranged in end-to-end relation to form the general outline of an elongated necktie, there being first and second end segments at respective opposite ends of the necktie;

b. a plurality of hinges, each hinge flexibly joining the ends of respective adjacent segments to each other;

c. decorative means bonded to the exposed surface of at least one segment for displaying selected sports related insignias; and d. wearing means attached to an end segment for enabling the sports tie to be worn around a person's neck.

2. A sports tie comprising:

a. a plurality of generally flat rigid segments having respective exposed surfaces and being arranged in end-to-end relation to form the general outline of an elongated necktie, there being first and second end segments at respective opposite ends of the necktie;

b. hinge means for flexibly joining the ends of the respective adjacent segments to each other;

c. decorative means bonded to the exposed surface of at least one segment for displaying selected insignias; and c. wearing means attached to an end segment for enabling the sports tie to be worn around a person's neck, wherein the exposed surface of at least one selected segment is finished to simulate the floor of a basketball court, and wherein the decorative means partially covers the selected segment exposed surface, so that a margin of simulated basketball court is visible around the decorative means.

3. A sports tie comprising:

a. a plurality of generally flat rigid segments having respective exposed surfaces and being arranged in end-to-end relation to form the general outline of an elongated necktie, there being first and second end segments at respective opposite ends of the necktie, wherein the segments are constructed to give the elongated necktie the outline of a baseball bat;

b. hinge means for flexibly joining the ends of the respective adjacent segments to each other;

c. decorative means bonded to the exposed surface of at least one segment for displaying selected insignias; and d. wearing means attached to an end segment for enabling the sports tie to be worn around a person's neck.

4. A sports tie comprising;

a. a plurality of generally flat rigid segments having respective exposed surfaces and being arranged in end-to-end relation to form the general outline of an elongated necktie, there being first and second end segments at respective opposite ends of the necktie;

b. hinge means for flexibly joining the ends of the respective adjacent segments to each other;

c. decorative means bonded to the exposed surface of at least one segment for displaying selected insignias;

d. wearing means attached to an end segment for enabling the sports tie to be worn around a person's neck; and e. a flat disk decorated in the form of a selected sports item, the disk being removably applied to the exposed surface of a selected segment.

5. The sports tie of claim 4 wherein the selected segment is an end segment.

6. The sports tie of claim 4 wherein the selected segment is the end segment to which the wearing means is attached, so that the decorative disk is adjacent the person's neck when the sports tie is worn.

7. An article worn around a person's neck for displaying selected sports related insignias comprising:

a. a plurality of thin and rigid segments, each segment having an exposed surface and a back side;

b. a plurality of hinges applied to the back sides of the segments for flexibly joining the respective adjacent segments for flexibly joining the respective adjacent segments in end-to-end relation to form the general outline of a long necktie, there being first and second end segments at respective opposite ends of the necktie;

c. a decorative decal or sticker bearing the sports related insignias and bonded to the exposed surface of at least one selected segment; and d. wearing means attached to a selected end segment for enabling the person to removably wear the article around the person's neck.

8. An article worn around a person's neck for displaying selected insignias comprising:

a. a plurality of thin and rigid segments, each segment having an exposed surface and a back side;

b. hinge means for flexibly joining the respective adjacent segments in end-to-end relation to form the general outline of a long necktie, there being first and second end segments at respective opposite ends of the necktie, wherein the segments are fabricated to give the necktie the outline of a baseball bat;

c. a decorative decal or sticker bearing the insignias and bonded to the exposed surface of at least one segment; and d. wearing means attached to a selected end segment for enabling the person to removably wear the article around the person's neck.

9. An article worn around a person's neck for displaying selected insignias comprising:

a. a plurality of thin and rigid segments, each segment having an exposed surface and a back side;

b. hinge means for flexibly joining the respective adjacent segments in end-to-end relation to form the general outline of a long necktie, there being first and second end segments at respective opposite ends of the necktie;

c. a decorative decal or sticker bearing the insignias and bonded to the exposed surface of at least one selected segment;

d. wearing means attached to a selected end segment for enabling the person to removably wear the article around the person's neck; and e. at least a portion of a disk bonded to the exposed surface of a selected segment, the disk being decorated to simulate a selected item of sports equipment.

10. The article of claim 9 wherein the selected segment is an end segment.

11. The article of claim 9 wherein the selected segment is the end segment to which the wearing means is attached, so that the simulated piece of sports equipment is adjacent the person's neck when the sports tie is worn.

12. An article worn around a person's neck for displaying selected insignias comprising:

a. a plurality of thin and rigid segments, each segment having an exposed surface and a back side, wherein the exposed surfaces of the respective segments are finished to simulate the floor of a basketball court;

b. hinge means for flexibly joining the respective adjacent segments in end-to-end relation to form the general outline of a long necktie, there being first and second end segments at respective opposite ends of the necktie;

c. a decorative decal or sticker bearing the insignias and bonded to the exposed surface of at least one segment, wherein the decorative decal or sticker partially overlies the selected segment exposed surface; and d. wearing means attached to a selected end segment for enabling the person to removably wear the article around the person's neck, so that the article displays the selected insignias on a segment representative of a basketball court.

13. A sports tie comprising:

a. a plurality of segments made from a clear plastic material and having respective exposed surfaces and back sides, the segments being arranged in end-to-end fashion to form the general outline of a long necktie;

b. a colored sheet bonded to the back side of at least one segment;

c. a plurality of hinges applied to the back sides of the segments for flexibly joining the respective adjacent segments;

d. selected sports indicia bonded to the exposed surface of at least one segment; and e. means attached to a selected end segment for enabling a person to removably wear the sports tie.

14. The sports tie of claim 13 further comprising a a round disk removably applied to a selected segment, the disk being decorated to simulate a selected piece of sports equipment.

15. A sports tie comprising:

a. a plurality of thin and rigid segments having respective front and back sides;

b. hinge means for flexibly joining the segments in end-to-end relation to form the general outline of a long necktie, there being two end segments;

c. means simulating a carpet bonded to the front side of at least one segment simulating the surface of a grass playing field;

d. indicia means imprinted on the carpet means for displaying selected sports-related information; and e. means attached to a selected end segment for enabling a person to removably wear the sports tie.

16. The sports tie of claim 15 further comprising a disk having the general outline of a football, the disk being removably applied to a selected segment.

* * * * *